US007329100B2

(12) United States Patent
Kashiwazaki et al.

(10) Patent No.: US 7,329,100 B2
(45) Date of Patent: Feb. 12, 2008

(54) CENTRIFUGAL FAN IMPELLER

(75) Inventors: Yoshio Kashiwazaki, Kiryu (JP); Youichi Nagata, Kiryu (JP)

(73) Assignee: Japan Servo Co., Ltd., Tokyo-to (JP)

( * ) Notice: Subject to any disclaimer, the term of this patent is extended or adjusted under 35 U.S.C. 154(b) by 0 days.

(21) Appl. No.: 11/339,610

(22) Filed: Jan. 26, 2006

(65) Prior Publication Data

US 2006/0171802 A1 Aug. 3, 2006

(30) Foreign Application Priority Data

Jan. 28, 2005 (JP) ..... 2005-020808

(51) Int. Cl.
*F04D 29/44* (2006.01)

(52) U.S. Cl. ..... 416/182; 416/187; 415/206

(58) Field of Classification Search ..... 415/98, 415/119, 149.3, 206; 416/182, 187, 500
See application file for complete search history.

(56) References Cited

U.S. PATENT DOCUMENTS

| | | | | |
|---|---|---|---|---|
| 6,007,300 | A * | 12/1999 | Saeki et al. | 416/178 |
| 6,942,459 | B2 * | 9/2005 | Li et al. | 416/178 |
| 7,154,750 | B2 * | 12/2006 | Li et al. | 361/695 |
| 2004/0131465 | A1 * | 7/2004 | Ochiai et al. | 415/206 |
| 2005/0207888 | A1 | 9/2005 | Kashiwazaki et al. | |

FOREIGN PATENT DOCUMENTS

| | | |
|---|---|---|
| JP | 11-218096 | 8/1999 |
| JP | 2001-140791 | 5/2001 |

OTHER PUBLICATIONS

U.S. Appl. No. 11/339,610, filed Jan. 26, 2006, Kashiwazaki, et al.
U.S. Appl. No. 11/392,749, filed Mar. 30, 2006, Shimada.
U.S. Appl. No. 11/685,326, filed Mar. 13, 2007, Hanazuka, et al.

* cited by examiner

*Primary Examiner*—Edward K. Look
*Assistant Examiner*—Nathan Wiehe
(74) *Attorney, Agent, or Firm*—Oblon, Spivak, McClelland, Maier & Neustadt, P.C.

(57) ABSTRACT

An impeller of a centrifugal fan, the impeller used in the centrifugal fan having a casing and the impeller rotatably mounted in the casing. The impeller includes a hub connecting a number of blades equiangularly disposed in a circumferential direction. The hub includes an outer circular hub partially covering an outer peripheral edge of the blade, and an inner circular hub partially covering an inner peripheral edge of the blade. The hubs are concentrically formed, and an opening is provided between the inner and outer circular hubs. The inner circular hub, outer circular hub and opening are arranged to allow air to flow back across the inner circular hub and within the casing to cool a control circuit disposed within the casing.

6 Claims, 5 Drawing Sheets

CENTRIFUGAL FAN IMPELLER

BACKGROUND OF THE INVENTION

1. Field of the Invention

The present invention relates to improvement of an impeller for realizing a centrifugal fan capable of responding to needs of a smaller and high-performance centrifugal fan.

2. Description of the Related Art

A centrifugal fan, which is frequently used for cooling heated components in office automation equipment or the like, is surely required to be improved, with needs for a smaller, high-performance, and a low cost device mounting the centrifugal fan. Therefore, the improvement of an impeller, which largely affects a noise when operating and a cooling of a heated component internally mounted to the centrifugal fan, is also required.

The related art documents, Japanese Patent Applications Laid-Open Nos. 2001-140791 and 11-218096, also are required to solve the above-described problems. Although it is not described in detail, the improvement of connecting structures on a shroud side and on a hub side is suggested so as to ensure stiffness of a blade while maintaining an aerating function, and to make fabrication of the blade, which maintains stiffness, easier. Each of the related arts is effective to a certain degree, but needs for the smaller and high-performance device is not limited, and there is still room for further improvement.

Hereinafter, the conventional centrifugal fan will be described with reference to FIG. 5.

FIG. 5 is a cross-sectional view of a centrifugal fan according to the related art.

A centrifugal fan 10 shown in FIG. 5 is mainly composed of a casing 12, a motor 13, a control circuit 14 and an impeller 15.

And the impeller 15 is mainly composed of a blade 15-1 and a hub 15-2.

And, in FIG. 5, reference numeral 12-1 denotes a suction opening.

In the conventional centrifugal fan 10, the hub 15-2 is provided on an end portion of the blade 15-1 so as to extend on inner and outer diameters thereof, and a connecting ring 15-4 is provided on an outer peripheral surface on a shroud side thereof, as means for ensuring stiffness of the blade 15-1.

A problem to be solved in the centrifugal fan 10 according to the above-described related art is to maintain stiffness of the blade 15-1, which may cause a noise when operating, and to realize a more effective cooling in response to an increase of heat generation of internally mounted components, with needs for the smaller and high-performance device.

SUMMARY OF THE INVENTION

In order to achieve the above-described object, according to a first aspect of the present invention, there is provided an impeller of a centrifugal fan, the impeller used in the centrifugal fan having a casing and the impeller rotatably mounted in the casing, wherein a hub connecting a number of blades equiangularly disposed in a circumferential direction, is composed of an outer circular hub partially covering an outer peripheral edge of the blade and an inner circular hub partially covering an inner peripheral edge of the blade, the hubs concentrically formed, and is provided with an opening between the inner and outer circular hubs.

According to a second aspect of the present invention, there is provided the impeller of the centrifugal fan according to the first aspect, wherein an outer peripheral edge of the outer circular hub is formed on an extension of an outer peripheral arc face of the edge of the blade, and an inner peripheral edge of the inner circular hub is formed on an extension of an inner peripheral arc face of the edge of the blade.

According to a third aspect of the present invention, there is provided the impeller of the centrifugal fan according to the first and second aspects, wherein a side wall of an opening provided between the outer and inner circular hubs is formed as an extension surface of a surface of the blade.

According to a fourth aspect of the present invention, there is provided the impeller of the centrifugal fan according to any one of the first to third aspects, wherein when a difference between an inner diameter of an inner peripheral surface of the inner circular hub and an outer diameter of the inner circular hub on the inner peripheral edge of the blade is set to A2, and a difference between an outer diameter and an inner diameter of the outer circular hub is set to A1, the differences A1 and A2 are made substantially equal, and when a difference between the inner diameter of the inner peripheral surface of the inner circular hub and an outer diameter of an outer peripheral surface of the outer circular hub on the inner peripheral edge of the blade is set to W, and a radial width of the opening formed between the inner and outer circular hubs is set to B, a ratio between the difference W and width B, B/W is in a range from 0.1 to 0.7.

DESCRIPTION OF THE ACCOMPANYING DRAWINGS

DESRIPTION OF THE PREFERRED EMBODIMENT

Hereinafter, an embodiment of a centrifugal fan impeller of the present invention will be described with reference to FIGS. 1 to 4.

Figure 1:
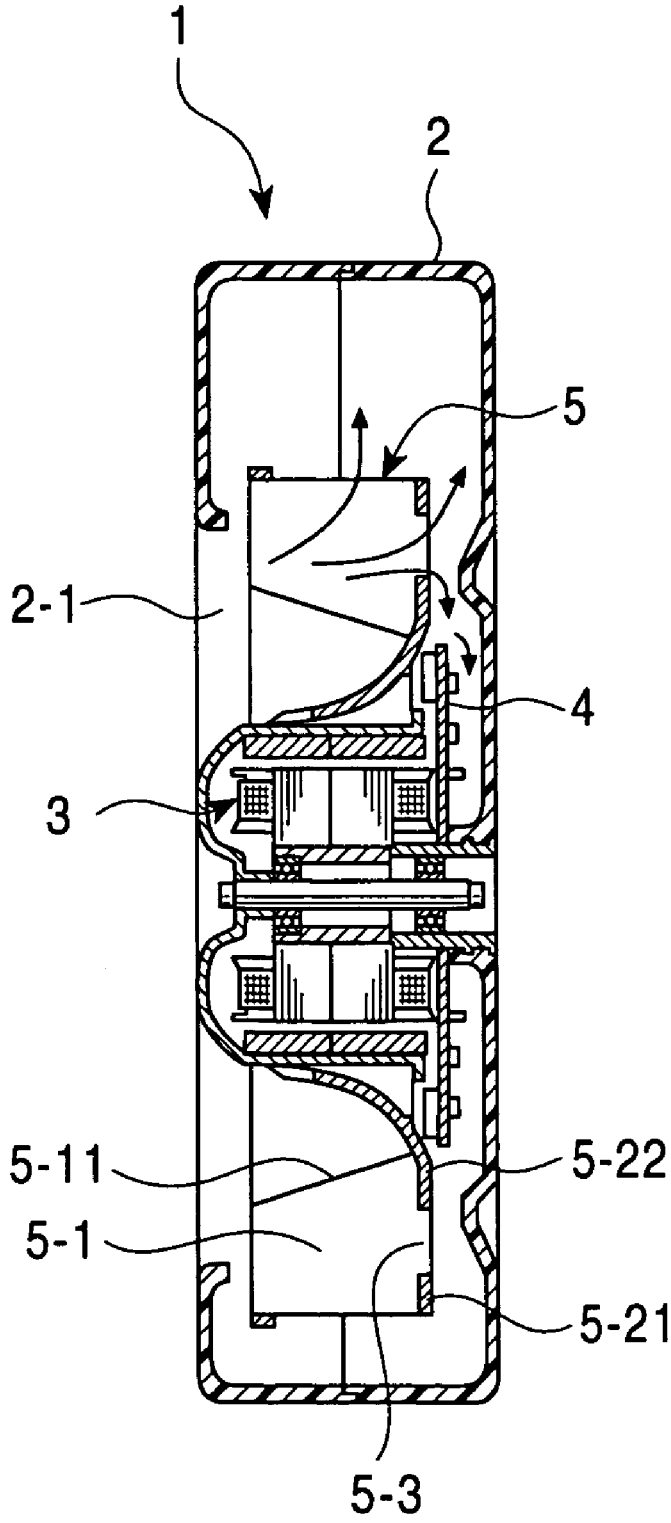
FIG. 1 is a cross-sectional view showing an embodiment of a centrifugal fan impeller of the present invention.

FIG. 1 is a cross-sectional view showing an embodiment of the centrifugal fan using the impeller of the present invention, and the structure of the centrifugal fan is similar to that of the known centrifugal fan disclosed in the above-mentioned related art, except for a structure of the impeller.

That is to say, a centrifugal fan 1 of the present embodiment is mainly composed of a casing 2, a motor 3, a control circuit 4, and an impeller 5.

Meanwhile, in FIG. 1, a reference numeral 2-1 denotes a suction opening of the centrifugal fan 1, a reference numeral 5-4 denotes a connecting ring provided on an outer peripheral surface on a shroud side of a blade 5-1.

Figure 2:
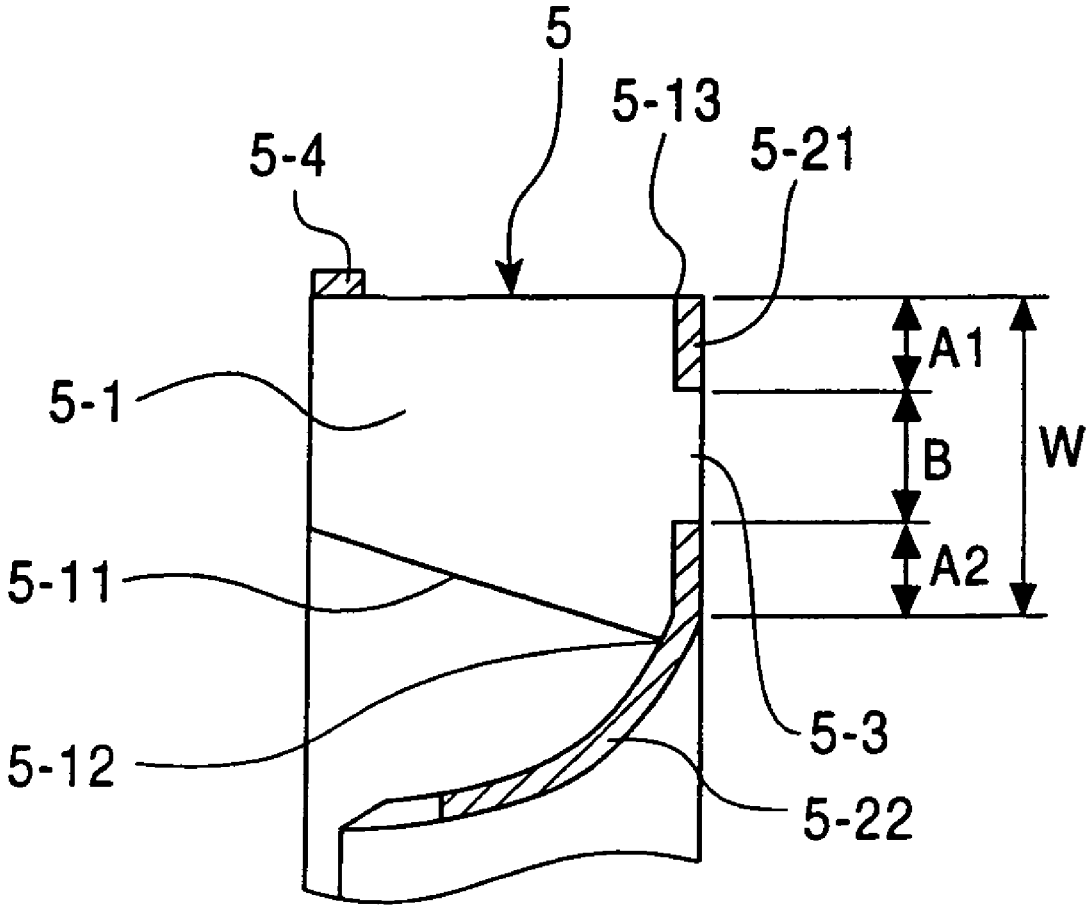
FIG. 2 is a partially enlarged cross-sectional view of the centrifugal fan impeller shown in FIG. 1.
Figure 3:
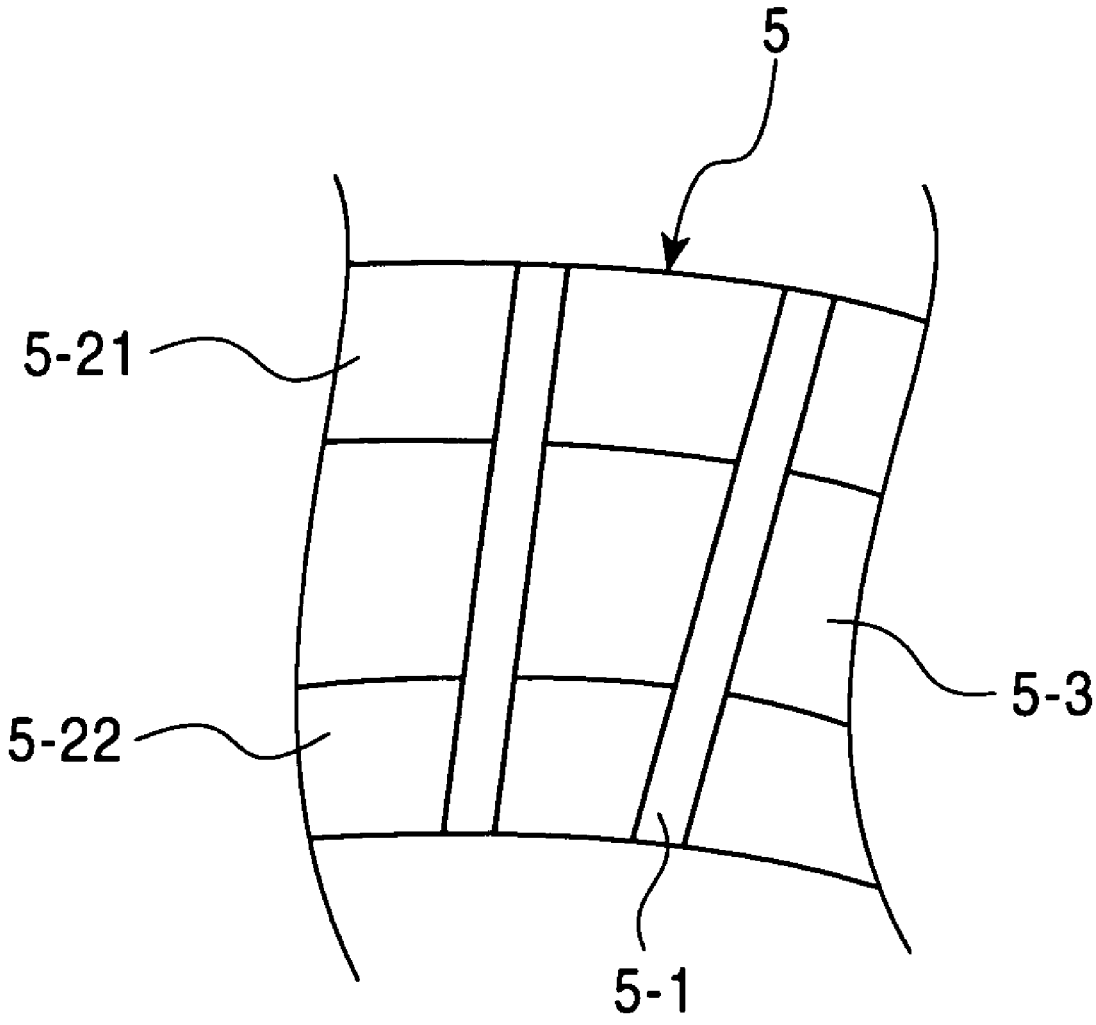
FIG. 3 is a partially enlarged front view seen from a shroud side, illustrating the centrifugal fan impeller and a hub shown in FIG. 1.
Figure 4:
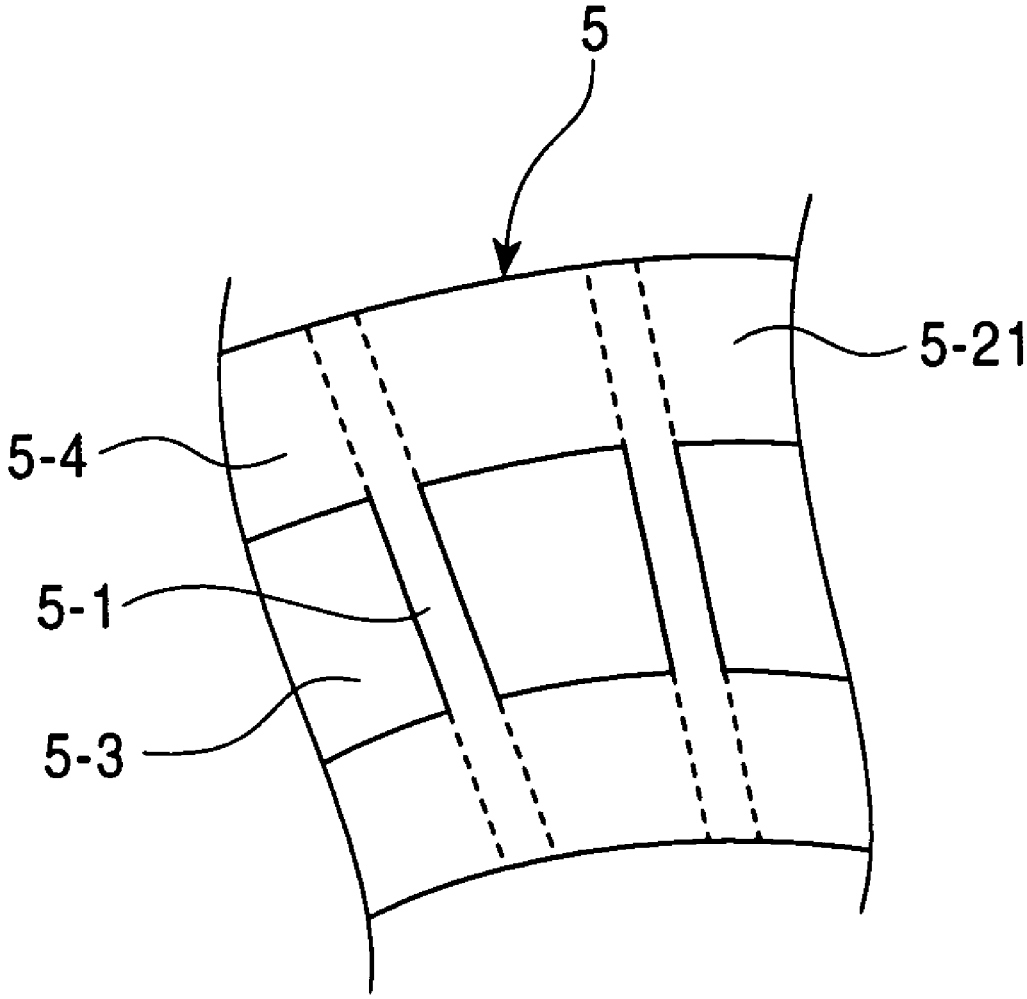
FIG. 4 is a partially enlarged rear view seen from a hub side, illustrating the centrifugal fan impeller and the hub shown in FIG. 1.

FIG. 2 is a partially enlarged cross-sectional view of the impeller 5 of the centrifugal fan 1 shown in FIG. 1, FIG. 3 is partially enlarged front view of the impeller 5 seen from the shroud side, and FIG. 4 is a partially enlarged rear view of the same seen from a hub 15-2 side, the side opposite to that in FIG. 3.

Figure 5:
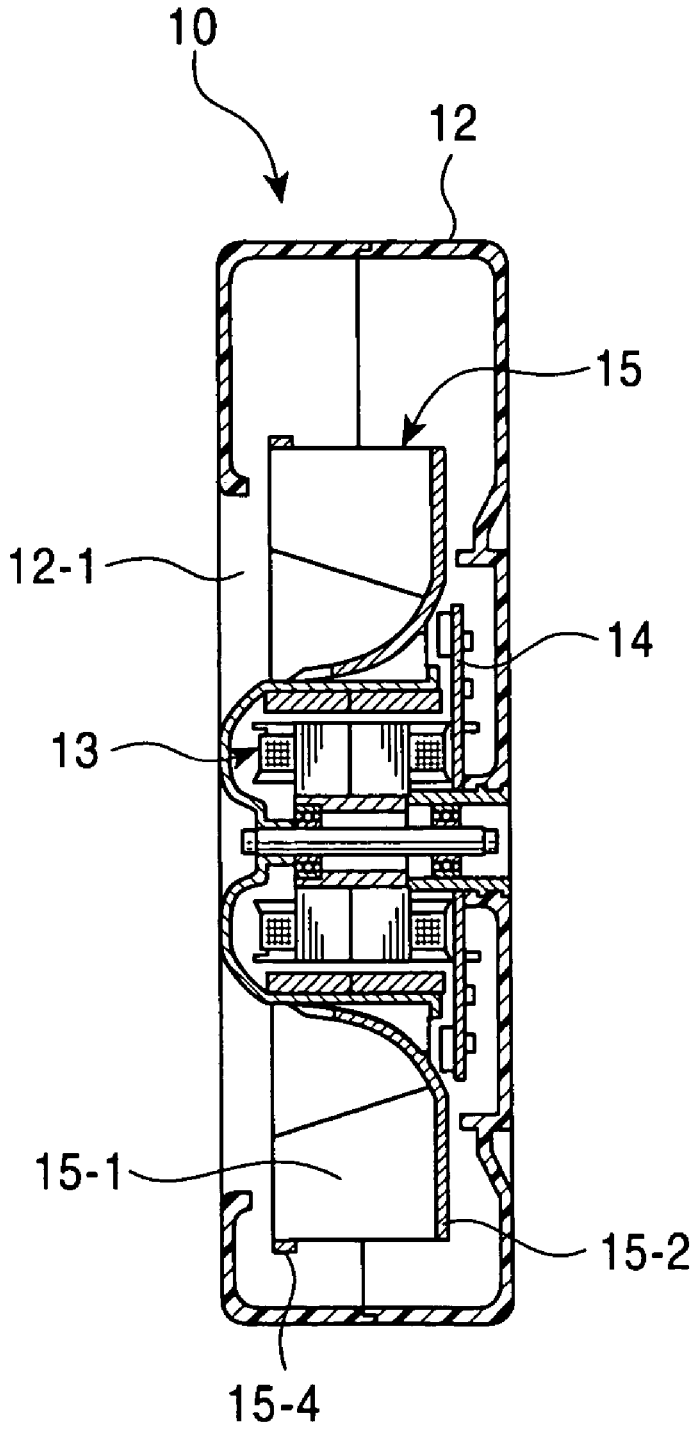
FIG. 5 PRIOR ART
FIG. 5 is a cross-sectional view of the centrifugal fan impeller of the related art.

In the conventionally known structure as disclosed in the above-mentioned known documents, the hub 15-2 entirely defilades inner and outer diameters of an end portion of a blade 15-1, ring members connecting in a circumferential direction on an outer peripheral edge on a hub 15-2 side thereof are formed, and a connecting ring 15-4 formed so as to cover a tip end on a shroud side of the blade 15-1 is attached (refer to FIG. 5).

On the other hand, in the impeller 5 of the centrifugal fan 1 of the present invention, an outer circular hub 5-21, which partially covers an edge 5-13 on an outer peripheral side of the blade 5-1, and an inner circular hub 5-22, which partially covers an edge 5-12 on an inner peripheral side of the blade 5-1, are concentrically formed, and an opening 5-3 is provided between the two inner and outer circular hubs 5-21 and 5-22, as means to ensure stiffness of a blade 5-1 as shown in above-mentioned FIGS. 2 to 4.

That is to say, the hub of the present invention is structured so as to ensure stiffness of the blade by connecting the inner and outer peripheral sides of the end portion of the blade 5-1 by means of the inner and outer circular hubs 5-22 and 5-21, respectively, as means for ensuring stiffness of the blade 5-1, which largely affects the noise when rotating, and so as to make air easily pass also in a direction of the control circuit 4, which is a heated component required to be cooled, through the opening 5-3 between the outer circular hub 5-21 and the inner circular hub 5-22, as indicated by arrows in FIG. 1.

And, in order to improve formability in a molding, which is general forming means of the impeller 5, it is preferable that an outer peripheral edge of the outer circular hub 5-21 is on an extension of an outer peripheral circular arc face of an edge of the blade 5-1 and an inner peripheral edge of the inner circular hub 5-22 is on an extension of an inner peripheral circular arc face 5-11 of the edge of the blade, and that a side wall of the opening 5-3 of the hub provided between the outer circular hub 5-21 and the inner circular hub 5-22 is formed as an extension surface of a surface of the blade 5-1.

And, as a result of a study of a flow of air passed through the opening 5-3 provided between the hubs 5-21 and 5-22 to freely pass also in a direction of a central control circuit 4, it has been confirmed that when a radial width of the inner circular hub 5-22 is set to A2 and that of the outer circular hub 5-21 is set to A1, the widths A1 and A2 are preferably made substantially equal, and when difference between an inner diameter of the inner circular hub 5-22 and an outer diameter of the outer circular hub 5-21 is set to W and a radial width of the opening 5-3 formed between the inner and outer circular hubs 5-21 and 5-22 is set to B, a ratio between the difference W and the width B, B/W, is preferably in a range from 0.1 to 0.7.

Herein, more specifically, the radial width A2 of the inner circular hub 5-22 is the difference between the inner diameter of the inner peripheral surface of the inner circular hub 5-22 and the outer diameter of the inner circular hub 5-22 on the inner peripheral edge 5-12 of the blade, as shown in FIG. 2.

And, the radial width A1 of the outer circular hub 5-21 is the difference between the outer diameter and inner diameter of the outer circular hub 5-21, as is evident from FIG. 2.

The centrifugal fan impeller of the present invention is capable of maintaining stiffness of a blade, which may cause a noise when operating, and of realizing a more effective cooling in response to an increase of heat generation of internally mounted components, with needs for a smaller and highly efficient device.

The centrifugal fan impeller of the present invention, structured as the first aspect, may maintain stiffness of a blade, which may cause a noise when operating, and realize a more effective cooling of heated internally mounted components.

And, the centrifugal fan impeller, structured as the second and third aspects, may improve formability in a molding, which is general forming means of the impeller.

Further, the centrifugal fan impeller, structured as the fourth aspects, may make a flow of air passed through an opening of a hub, freely pass also in a direction of a central control circuit.

What is claimed is:

1. An impeller rotatably mounted in a centrifugal fan comprising:

a casing with an inward protruding bump;

a hub connecting a number of blades equiangularly disposed in a circumferential direction, said hub including an outer circular hub partially covering an outer peripheral edge of the blade, and an inner circular hub partially covering an inner peripheral edge of the blade, wherein the hubs are concentrically formed, and an opening is provided between the inner and outer circular hubs opposite from said inward protruding bump, and said inner circular hub, outer circular hub, inward protruding bump, and opening are arranged to allow air to flow back across said inner circular hub and within said casing to cool a control circuit disposed within said casing.

2. The impeller of the centrifugal fan as claimed in claim 1, wherein a difference between an inner diameter of a planar inner peripheral surface of the inner circular hub and an outer diameter of the inner circular hub on the inner peripheral edge of the blade is set to A2, and a difference between an outer diameter and an inner diameter of the outer circular hub is set to A1, the differences A1 and A2 are substantially equal, a difference between the inner diameter of the planar inner peripheral surface of the inner circular hub and an outer diameter of an outer peripheral surface of the outer circular hub on the inner peripheral edge of the blade is set to W, and a radial width of the opening formed between the inner and outer circular hubs is set to B, with a ratio (B/W) between the difference W and width B in a range from 0.1 to 0.7.

3. The impeller of the centrifugal fan as claimed in claim 1, wherein an outer peripheral edge of the outer circular hub is formed on an extension of an outer peripheral arc face of the edge of the blade, and an inner peripheral edge of the inner circular hub is formed on an extension of an inner peripheral arc face of the edge of the blade.

4. The impeller of the centrifugal fan as claimed in claim 3, wherein a difference between an inner diameter of a planar inner peripheral surface of the inner circular hub and an outer diameter of the inner circular hub on the inner peripheral edge of the blade is set to A2, a difference between an outer diameter and an inner diameter of the outer circular hub is set to A1, the differences A1 and A2 are substantially equal, a difference between the inner diameter of the planar inner peripheral surface of the inner circular hub and an outer diameter of an outer peripheral surface of the outer circular hub on the inner peripheral edge of the blade is set to W, and a radial width of the opening formed between the inner and outer circular hubs is set to B, with a ratio (B/W) between the difference W and width B in a range from 0.1 to 0.7.

5. The impeller of the centrifugal fan as claimed in claim 1 or 3, wherein a side wall of an opening provided between the outer and inner circular hubs is formed as an extension surface of a surface of the blade.

6. The impeller of the centrifugal fan as claimed in claim 5, wherein a difference between an inner diameter of a planar inner peripheral surface of the inner circular hub and an outer diameter of the inner circular hub on the inner peripheral edge of the blade is set to A2, a difference between an outer diameter and an inner diameter of the outer circular hub is set to A1, the differences A1 and A2 are substantially equal, a difference between the inner diameter of the planar inner peripheral surface of the inner circular hub and an outer diameter of an outer peripheral surface of the outer circular hub on the inner peripheral edge of the blade is set to W, and a radial width of the opening formed between the inner and outer circular hubs is set to B, with a ratio (B/W) between the difference W and width B in a range from 0.1 to 0.7.

* * * * *